United States Patent [19]

Denslow et al.

[11] Patent Number: 4,881,514

[45] Date of Patent: Nov. 21, 1989

[54] ARCHERY BOW

[75] Inventors: Jurnior J. Denslow; Ronald S. Denslow, both of Lakeview, Mich.

[73] Assignee: Denslow Incorporated, Lakeview, Mich.

[21] Appl. No.: 213,313

[22] Filed: Jun. 30, 1988

[51] Int. Cl.[4] ..... F41B 5/00

[52] U.S. Cl. ..... 124/23 R; 24/24 R; 24/88

[58] Field of Search ..... 124/23 R, 41 A, 24 R, 124/21, 20 A, 26, 88, 1

[56] References Cited

U.S. PATENT DOCUMENTS

| | | | |
|---|---|---|---|
| 2,854,967 | 10/1958 | Eberbach . | |
| 3,397,685 | 8/1968 | Walker | 124/24 R |
| 3,486,495 | 12/1969 | Allen . | |
| 3,491,739 | 1/1970 | Scrobell . | |
| 3,517,658 | 6/1970 | Shurts . | |
| 3,538,902 | 11/1970 | Fowkes . | |
| 3,599,621 | 8/1971 | Scrobell . | |
| 3,612,028 | 10/1971 | Karbo . | |
| 4,192,280 | 3/1980 | Rickard . | |
| 4,252,100 | 2/1981 | Rickard . | |
| 4,492,214 | 1/1985 | Kielhoffer | 124/24 R |

*Primary Examiner*—Andrew V. Kundrat
*Assistant Examiner*—Carol I. Bordas
*Attorney, Agent, or Firm*—Price Heneveld Cooper DeWitt & Litton

[57] ABSTRACT

An archery bow which facilitates accurate shooting of an arrow and a construction which facilitates an easy and comfortable manner for carrying the bow, includes a riser defining a forwardly opening recess and a rearwardly projecting handle. Within the recess is provided a swivel hand grip with which the archer may grasp to alleviate deflections in the arrow's flight caused by sligth movements of the archer's wrist during the shooting process. The riser also includes an elongated slot which is adapted to adjustably mount an overdraw adapter to thereby provide a greater versatility in shooting arrows having varying lengths.

9 Claims, 1 Drawing Sheet

ARCHERY BOW

BACKGROUND OF THE INVENTION

The present invention pertains to archery bows, and in particular to a bow which is structured to not only facilitate improved shooting, but also enhance the portability and manipulation of the bow.

In the use of a bow, a substantial force is applied in the drawing of the bowstring in preparation of firing the arrow. This force is generally resisted solely by the arm of the archer. For optimum accuracy, it is essential that the bow be held as steady as possible, since any slight movement of the wrist or arm during aiming or release of the bowstring causes deflection of the arrow from its intended course. As can be readily appreciated, the elimination of any reactionary movements by the archer upon release of the drawn bowstring is practically impossible, even for experienced archers.

In an effort to alleviate this difficulty, past artisans have fabricated archery bows provided with swivel hand grips to compensate for the slight movements experienced in the archer's wrist during shooting. An example of such a construction is illustrated in U.S. Pat. No. 3,397,685 to Walker and entitled UNIVERSALLY MOUNTED ARCHERY BOW HANDLE.

The provision of such swivel hand grips has enhanced the shooting accuracy of archery bows. However, the manner in which the swivel hand grips have heretofore been incorporated into the bows has had a detrimental effect on their ability to be easily carried and manipulated by the archer. More specifically, the frames of the bows are arranged forwardly about the hand grips to thereby provide a sufficient space for the archer's hand, to avoid interference with the shooting process and to provide adequate structural strength during the drawing of the bowstring. Yet, this construction hampers the easy transport of the bow during hunting. For instance, when hunting, the archer generally keeps the arrow on the bowstring so as to be prepared to quickly shoot should he come upon some game. Hence, for safety reasons, it is important to hold the bow with the bowstring over the riser so that the arrow head is directed downwardly toward the ground. This orientation, however, forces the archer to keep his arm and wrist in an uncomfortable bent position as he holds the frame around the hand grip. Also, due to the imbalance of the bow in this position and the fatigue which develops in the archer's arm, the bowstring tends to tilt and rub upon the archer's body and/or arm.

SUMMARY OF THE INVENTION

The aforementioned problems and deficiencies are overcome in the present invention, wherein a bow having a swivel hand grip and a unique frame construction effects not only accurate shooting, but also easy carrying of the bow.

The present archery bow includes a riser having a central recess in which a swivel hand grip is rotatably mounted to enhance the shooting accuracy of the bow. Adjacent the hand grip is provided a handle integrally connected with the riser. The handle projects rearwardly of the hand grip in a direction generally toward the archer during the shooting of the arrow.

By using the bow of the present invention, the archer may retain the swivel hand grip for improved accuracy upon shooting, and yet still be able to easily carry the bow in a safe and convenient manner. The present handle balances the bow in the user's hand to facilitate a relaxed holding posture so that the tendency of the bowstring to rub on the archer while carrying the bow is alleviated. Moreover, the archer may easily and comfortably carry the bow with the arrow directed downwardly for greater safety. Also, due to the positioning of the handle inwardly of the concave shape of the bow, the riser is better able to cope with the large forces exerted during shooting and thereby provide a more structurally sound bow.

In a second aspect of the invention, the riser is provided with an elongated slot by which an overdraw adapter, facilitating the use of shorter arrows, may be adjustably mounted. This adjustable mounting of an overdraw adapter provides a much greater versatility for the archer, since a single adapter may be adjustably set to accommodate a wide range of arrows having varying lengths.

These and other objects, advantages and features of the present invention will be more fully understood and appreciated by reference to the written specification and appended drawings.

DETAILED DESCRIPTION OF THE PREFERRED EMBODIMENTS

Figure 1:
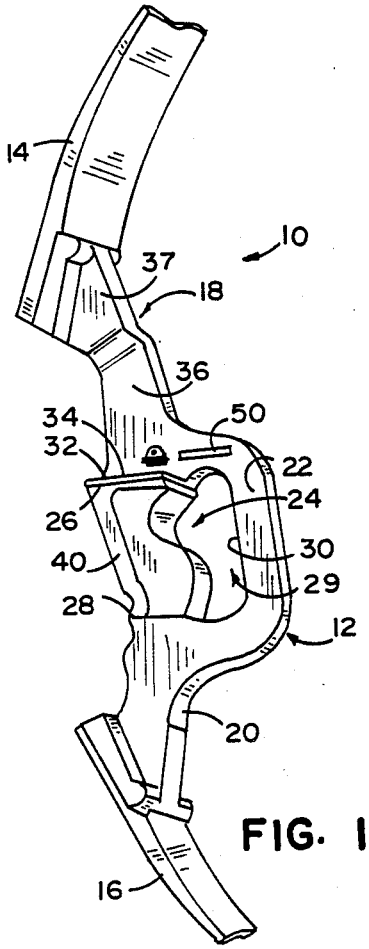
FIG. 1 is a fragmentary perspective view of a bow of the present invention.
Figure 2:
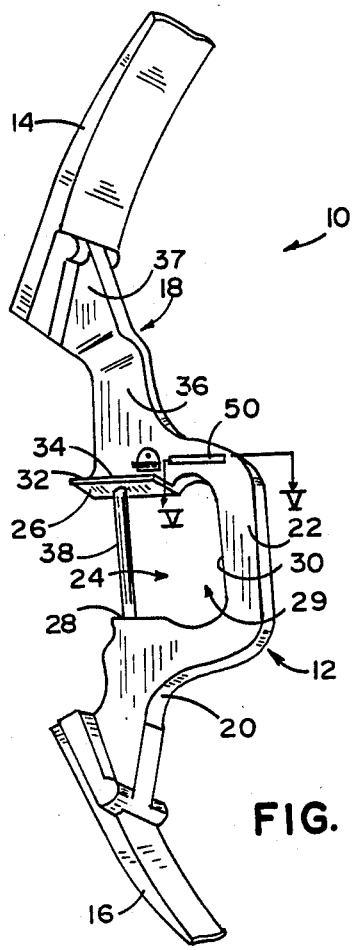
FIG. 2 is a perspective view of the bow without the swivel hand grip.

In the preferred embodiment, an archery bow 10 designed for improved shooting and handling includes a central riser 12 and a pair of limbs 14, 16 extending outwardly in opposite directions from riser 12 (FIGS. 1 and 2). Riser 12 and limbs 14, 16 are fixedly connected in a conventional manner, such as by screws (not shown), to form a single integral article. Bow 10 may be constructed as either a composite recurve type bow or a compound bow. Riser 12 is preferably constructed as a magnesium cast, but of course could be composed of a variety of other materials having the requisite strength and resiliency characteristics.

Riser 12 includes an upper leg 18 fixedly attached to upper limb 14, an intermediate handle 22 and a lower leg 20 fixedly attached to lower limb 16. More specifically, handle 22 is offset rearwardly from legs 18, 20 to form therewith a substantially U-shaped, forwardly opening recess 24. Recess 24 is bounded on opposite upper and lower sides by an upper mounting face 26 and an opposed lower mounting face 28. The inner surface 30 of handle 22 forms the bight segment of the U-shaped recess 24 and thereby interconnects mounting faces 26, 28. Preferably, as seen in FIGS. 1 and 2, recess 24 bulges outwardly at handle 22 to provide a larger space 29 through which the archer's hand is received to facilitate an easier and more comfortable grasping of the handle.

Upper mounting face 26 is defined by a plate member 32 which includes an opposite upper surface 34 aligned with the bowstring to function as the arrow shelf. To facilitate this construction and the passage of the arrow along shelf 34 during shooting, upper leg 18 includes a securing segment 37 and a laterally offset portion 36 of a narrower construction adjacent shelf 34. Offset portion 36 is aligned with and lies substantially within the same plane as handle 22. This arrangement, then, also offsets handle 22 from the path of the arrow to thereby avoid any interference of handle 20 with shooting. The lower leg 20 is shaped to gradually expand and bend laterally back into alignment with securing segment 35 so that the limbs 14, 16 are vertically aligned and mounting faces 26, 28 overlap (as shown in FIGS. 1 and 2).

Between mounting faces 26, 28 is mounted a swivel pin 38 which is fixedly attached to both mounting faces 26, 28 (FIG. 2). Pin 38 is positioned centrally of limbs 14, 16, such that it lies substantially within the same plane as the pulleys (of a compound bow) and the bowstring. A hand grip 40 is mounted about pin 38 (FIG. 1) to provide means by which the archer may hold the bow during shooting to thereby increase the accuracy of the shot, as discussed above.

Figure 4:
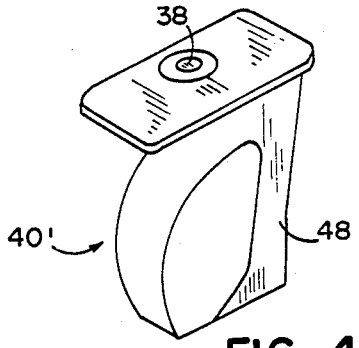
FIG. 4 is a perspective view of a second embodiment of the hand grip.
Figure 3:
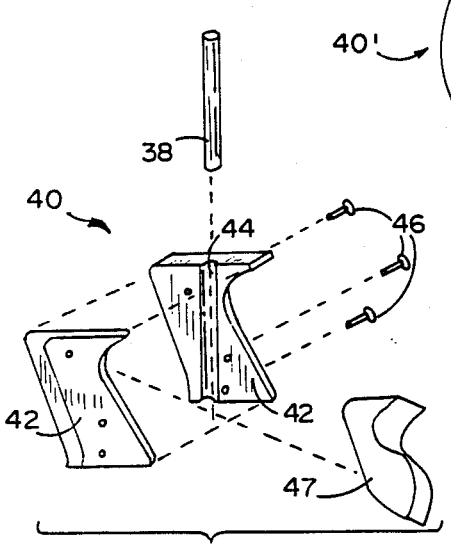
FIG. 3 is an exploded view of a first embodiment of the hand grip.
Figure 5:
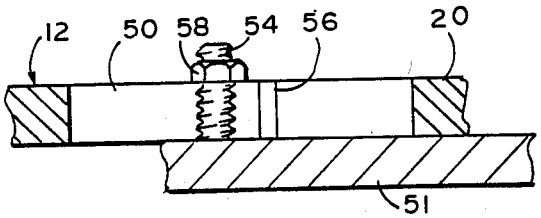
FIG. 5 is an enlarged, fragmentary cross-sectional view taken along line V—V in FIG. 2.

Hand grip 40 may be of a split construction (FIG. 3), which includes a pair of corresponding members 42 each having a channel 44 which is adapted to receive therein swivel pin 38. The two members 42 are connected together about pin 38 via the use of screws 46 or other fastening means. An optional hand adapter 47 may also be snap-fit into place to better fit the archer's hand. Alternatively, hand grip 40 may be constructed as a solid member 48 (FIG. 4). Of course, hand grip 40 may have a variety of other constructions and configurations.

At the interconnection of upper leg 18 and handle 20 is provided a slit 50 which effects the adjustable mounting of an overdraw adapter 51. Overdraw adapters are utilized in the sport of archery to facilitate the use of shorter arrows, which generally have a faster flight and cover a greater distance than conventional length arrows. More specifically, an overdraw adapter typically includes a first member extending from the riser toward the bowstring and archer, and a lateral element which is essentially parallel to the arrow shelf to support the shorter arrow when the bowstring is drawn back. The overdraw adapters, heretofore, have been fastened directly into a threaded bore provided in the riser.

In the present invention, slot 50 adjustably mounts an overdraw adapter 51 having a lateral bolt 54 and pin 56. More particularly, bolt 54 and pin 56 are passed through slot 50 to provide a secure mounting arrangement for the adapter 51. In this arrangement, the overdraw adapter is easily shifted forwardly or rearwardly depending on the particular length of arrow to be used. Once adapter 51 is positioned, it is easily locked in place by tightening nut 58. A variety of other mounting arrangements could be utilized to mount the overdraw adapter in slot 50.

Of course, it is understood that the above are merely preferred embodiments of the invention, and that various other embodiments as well as many changes and alterations may be made without departing from the spirit and broader aspects of the invention, as defined in the claims.

The embodiments of the invention in which an exclusive property or privilege is claimed are defined as follows.

1. An archery bow comprising:

an elongated flexible member having a central riser and a pair of limbs extending oppositely therefrom, said riser being shaped to define a generally channel-shaped recess opening away from an archer when using said archery bow and a handle positioned adjacent to and rearwardly of said recess and inwardly of the concave shape of said bow to effect an easy, comfortable manner of carrying the bow;

a bowstring attached to each end of said limbs and extending tautly therebetween, said bowstring being positioned rearwardly of said handle such that said handle is oriented between said recess and said bowstring; and a hand grip rotatably mounted to said riser in said recess for improved accuracy in shooting.

2. The archery bow of claim 1 in which said riser is shaped with said handle to form a substantially U-shaped recess bounded on three sides by a pair of mounting faces and said handle, and in which said hand grip is rotatably mounted on a swivel pin extending between said mounting faces.

3. The archery bow of claim 2 further including an elongated slot positioned within said handle of said riser to adjustably attach an overdraw adapter for movement along said slot toward or away from the longitudinal axis of said flexible member, said slot being oriented at substantially right angles to the longitudinal axis of said flexible member.

4. The archery bow of claim 2 in which said riser further includes an arrow shelf which is substantially aligned with said bowstring to facilitate proper shooting of the arrow, and wherein said handle is laterally spaced relative to said arrow shelf to thereby avoid interference with the shooting of the arrow.

5. The archery bow of claim 1 in which said riser further includes an arrow shelf which is substantially aligned with said bowstring to facilitate proper shooting of the arrow, and wherein said handle is laterally spaced relative to said arrow shelf to thereby avoid interference with the shooting of the arrow.

6. An archery bow comprising an elongate flexible member having a central riser and a pair of limbs extending oppositely therefrom, said riser including a laterally extending arrow shelf and an elongated slot for adjustably attaching an overdraw adapter to said riser for movement along said slot toward or away from said arrow shelf, said slot being positioned substantially parallel to the arrow shelf to facilitate adjustment of the adapter toward and away from a bowstring interconnecting said limbs.

7. The archery bow of claim 6 in which said riser further includes a rearwardly projecting handle positioned inwardly of the concave shape of said bow which is laterally offset from said arrow shelf to avoid interference with the shooting of an arrow and to facilitate easy carrying of the bow.

8. The archery bow of claim 7 further including a swivel hand grip rotatably mounted to said riser about an axis oriented substantially orthogonally to said arrow shelf to provide greater accuracy during shooting.

9. The archery bow of claim 6 further including a swivel hand grip rotatably mounted to said riser about an axis oriented substantially orthogonally to said arrow shelf to provide greater accuracy during shooting.

* * * * *